US005479248A

United States Patent [19]

Yamaguchi et al.

[11] Patent Number: 5,479,248

[45] Date of Patent: Dec. 26, 1995

[54] IMAGE FORMING APPARATUS HAVING FIXING DEVICE

[75] Inventors: Masao Yamaguchi, Saitama; Naruhito Yashida, Kanagawa, both of Japan

[73] Assignee: Kabushiki Kaisha Toshiba, Kawasaki, Japan

[21] Appl. No.: 294,652

[22] Filed: Aug. 23, 1994

[30] Foreign Application Priority Data

Sep. 22, 1993 [JP] Japan ..... 5-236814

[51] Int. Cl.[6] ..... G03G 15/20

[52] U.S. Cl. ..... 355/290; 219/216

[58] Field of Search ..... 355/282, 285, 355/289, 290; 219/216, 469

[56] References Cited

U.S. PATENT DOCUMENTS

| | | | |
|---|---|---|---|
| 4,568,275 | 2/1986 | Sakurai | 219/216 X |
| 4,813,868 | 3/1989 | Soga | 219/216 X |
| 4,814,819 | 3/1989 | Torino et al. | 355/289 X |
| 5,047,809 | 9/1991 | Owada et al. | 355/284 |
| 5,123,151 | 6/1992 | Uehara et al. | 355/282 X |
| 5,289,246 | 2/1994 | Menjo | 355/285 |
| 5,345,301 | 9/1994 | Satoh et al. | 355/290 |

*Primary Examiner*—Robert Beatty
*Attorney, Agent, or Firm*—Foley & Lardner

[57] ABSTRACT

An image forming apparatus includes a fixing device to fix a developer image on an image bearing medium. The fixing device includes a first roller with a rubber layer coated on a shaft, the first roller being in contact with the developer image on the image bearing medium, and a second roller with a rubber layer having a smaller deformation than the first roller rubber layer coated on a shaft. The first and second rollers are rotatably pressed against each other to form a nip. The rubber layer thickness $h_1$ of the first roller satisfies $0.512H<h_1<H$, where H satisfies the following equation:

$$[E_1\{A_1^4-(A_1-t_1)^4\}+E_2Y]\cdot[\{A_1^4-(A_1-t_1)^4\}+4H(-3t_1A_1^2+3t_1^2A_1-t_1^3)]+H\{A_1^4-(A_1-t_1)^4\}\cdot\{-4E_1(3t_1A_1^2-3t_1^2A_1+t_1^3)\}=0$$

where $R_1$: first roller radius (mm)

$E_1$: Young's modulus of the first roller shaft ($Kg/mm^2$)

$t_1$: thickness of the first roller shaft (mm)

$h_1$: rubber layer thickness of the first roller (mm)

$R_2$: second roller radius (mm)

$E_2$: Young's modulus of the second roller shaft ($Kg/mm^2$)

$t_2$: thickness of the second roller shaft (mm)

$h_2$: rubber layer thickness of the second roller (mm)

$A_1=R_1-H$ $A_2=R_2-h_2$ $Y=A_2^4-(A_2-t_2)^4$.

10 Claims, 3 Drawing Sheets

IMAGE FORMING APPARATUS HAVING FIXING DEVICE

BACKGROUND OF THE INVENTION

1. Field of the Invention

The present invention relates to an image forming apparatus and particularly relates to an image forming apparatus having a fixing unit with improved fixing characteristic.

2. Description of the Related Art

Electrophotographic apparatus including electronic copiers and laser beam printers, etc. are provided with a fixing unit where a developer image formed on a photosensitive body and then transferred onto an image bearing medium is fixed on the image bearing medium by heat. Such a fixing unit comprises a pair of rollers to catch and feed the image bearing medium and at least one of the rollers is a heating roller. For improvement of the fixing characteristic of such heat fixing unit in electrophotographic apparatus, it is necessary to extend the fixing time. To extend the fixing time, the rotation speed of the pair of rollers may be made lower to slow down the fixing speed or the nip width by which the pair of rollers catch the image bearing medium may be enlarged. The nip width may be enlarged by larger outer diameter of the rollers, lower rubber hardness on outer surface of the rollers, increased roller pressure or thicker rubber.

When the fixing speed is slowed down for a longer fixing time, the operation speed of the process unit in the whole electrophotographic apparatus must be made lower, which results in a slower speed for image formation.

On the other hand, when the nip width is made larger for a longer fixing time, it involves the drawbacks as listed below:

1. Larger outer diameter of the rollers results in a larger fixing unit, which leads to a higher cost;

2. Lower rubber hardness tends to result in wrinkles on the image bearing medium;

3. Larger pressurizing force at rollers causes larger distortion at the roller shafts, which results in lower feeding performance for the image bearing medium; and 4. When the outer diameter of the rollers is kept constant, thicker rubber necessarily causes smaller shaft diameter. This leads to lower shaft rigidity causing larger distortion at the shaft, which results in lower feeding performance for the image bearing medium. On the other hand, when the shaft diameter is kept constant, thicker rubber results in larger outer diameter of the rollers, which leads to a larger fixing unit. Besides, a fixing unit for color electrophotographic apparatus requires a rubber layer coating on the heat roller. This means that thicker rubber results in a larger temperature difference between the roller surface and the shaft. In this case, when the surface temperature is raised to a required value, the shaft is inevitably heated up to an unusually high temperature, which deteriorates the bonding strength between the shaft and the rubber layer and may result in separation of the rubber layer.

SUMMARY OF THE INVENTION

It is an object of the present invention to provide an image forming apparatus enabling improved fixing characteristic with prolonged fixing time. There the drawbacks described above are eliminated in spite of larger nip width at a pair of rollers.

According to the present invention, there is provided an image forming apparatus including fixing means to fix a developer image on an image bearing medium, wherein the fixing means comprising a first roller with a rubber layer coated on a shaft, the first roller being in contact with the developer image on the image bearing medium; and a second roller with a rubber layer having smaller deformation than the first roller rubber layer coated on the shaft; wherein the first and second rollers being rotatably pressed against each other to form a nip and the rubber layer thickness $h_1$ of the first roller satisfies $0.512H<h_1<H$ where H satisfies the following equation:

$$[E_1\{A_1^4-(A_1-t_1)^4\}+E_2Y]\cdot[\{A_1^4-(A_1-t_1)^4\}+4H(-3t_1A_1^2+3t_1^2A_1-t_1^3)]+H\{A_1^4-(A_1-t_1)^4\}\cdot\{-4E_1(3t_1A_1^2-3t_1^2A_1+t_1^3)\}=0$$

where $R_1$: First roller radius [mm]
$E_1$: Young's modulus of first roller shaft [Kg/mm$^2$]
$t_1$: Thickness of first roller shaft [mm]
$h_1$: Rubber layer thickness of first roller [mm]
$R_2$: Second roller radius [mm]
$E_2$: Young's modulus of second roller shaft [Kg/mm$^2$]
$t_2$: Thickness of second roller shaft [mm]
$h_2$: Rubber layer thickness of second roller [mm]
$A_1=R_1-H$
$A_2=R_2-h_2$
$Y=A_2^4-(A_2-t_2)^4$ Further according to the present invention, there is provided a fixing device comprising a first roller with a rubber layer coated on a shaft, the first roller being in contact with a developer image on an image bearing medium; and a second roller with a rubber layer having smaller deformation than the first roller rubber layer coated on the shaft; wherein the first and second rollers being rotatably pressed against each other to form a nip and, when the rubber layer thickness $h_1$ of the first roller satisfying the formula below is H, $h_1$ satisfies $0.512H<h_1<H$:

$$[E_1\{A_1^4-(A_1-t_1)^4\}+E_2Y]\cdot[\{A_1^4-(A_1-t_1)^4\}+4h_1(-3t_1A_1^2+3t_1^2A_1-t_1^3)]+h_1\{A_1^4-(A_1-t_1)^4\}\cdot\{-4E_1(3t_1A_1^2-3t_1^2A_1+t_1^3)\}=0$$

where $R_1$: First roller radius [mm]
$E_1$: Young's modulus of first roller shaft [Kg/mm$^2$]
$t_1$: Thickness of first roller shaft [mm]
$h_1$: Rubber layer thickness of first roller [mm]
$R_2$: Second roller radius [mm]
$E_2$: Young's modulus of second roller shaft [Kg/mm$^2$]
$t_2$: Thickness of second roller shaft [mm]
$h_2$: Rubber layer thickness of second roller [mm]
$A_1=R_1-h_1$
$A_2=R_2-h_2$
$Y=A_2-(A_2-t_2)^4$

DETAILED DESCRIPTION OF THE DRAWINGS

DETAILED DESCRIPTION OF THE PREFERRED EMBODIMENT

Referring to the attached drawings, preferred embodiments of the present invention will be described in details below.

Figure 1:
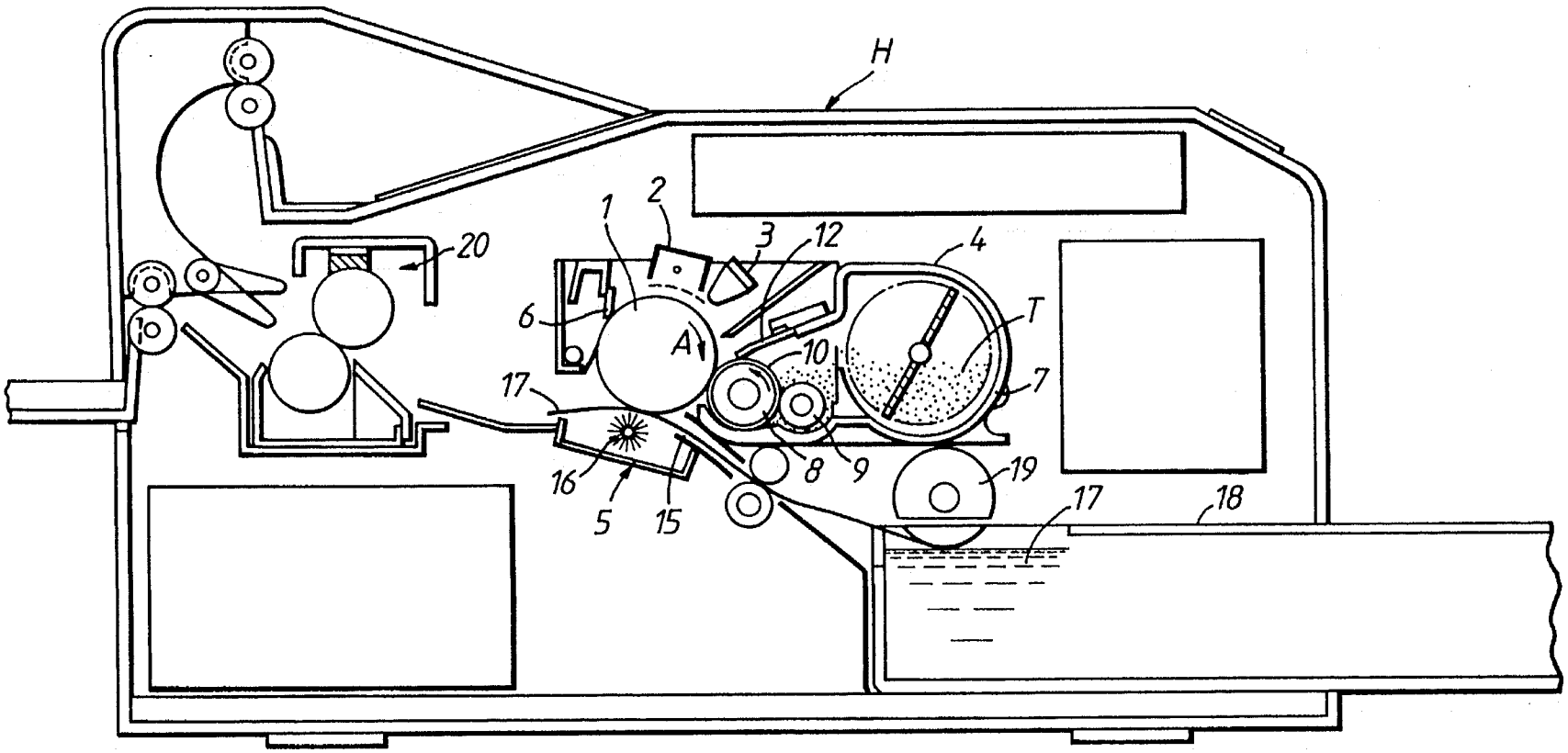
FIG. 1 is a diagram to schematically show an image forming apparatus according to an embodiment of the present invention.

FIG. 1 shows an image forming apparatus according to an embodiment of the present invention. A photosensitive drum 1 serving as an image carrier is located substantially at the center of a main body H and makes rotation in the direction shown with arrow A. The surface of the photosensitive drum is formed by organic photoconductor (OPC). Around the photosensitive drum 1 are disposed a charger 2, an image exposure unit 3 consisting of LED array, a developing unit 4, a transfer unit 5 and a cleaning unit 6 along the rotation direction of the photosensitive drum 1.

The charger 2 uniformly charges the surface of the photosensitive drum 1 at 400 to 700 V. The exposure unit 3 radiates the LED beam onto the surface of the photosensitive drum 1 to form an electrostatic latent image corresponding to the image information for recording or copying. The developing unit 4 is provided with a hopper 7 to accommodate single component developer with frictional electrification property (hereinafter called toner) T. The hopper 7 is provided inside with a developing roller 8 and a feeding roller 9 so That the feeding roller 9 feeds the toner T to the developing roller 8 and the developing roller 8 develops an electrostatic latent image by applying toner T fed from the feeding roller 9 onto the photosensitive drum 1.

A toner layer forming blade 12 to form a thin toner layer with spreading toner T is pressed against the developing roller 8. The toner layer forming blade 12 comprises a 0.15 mm thick phosphor bronze plate having a silicone rubber chip hemisphere with a radius of 1.5 mm at its end. The silicone rubber chip is in contact with the developing roller 8. Toner T passing the contacting part is charged under friction to have the same negative polarity as the charging polarity at the photosensitive drum 1 and forms one or two toner layers.

The transfer unit 5 is opposed to the peripheral surface of the photosensitive drum 1 via a paper feed path 15 under the photosensitive drum 1. In the transfer unit 5, a cylindrical brush 16 is in light contact with the photosensitive drum 1 and makes revolutions at a speed equivalent to or about 1% different from the speed of the photosensitive drum 1.

The main body H is, at the lower part of either side, provided with a paper feed unit 18 to store and feed paper 17 serving as the image bearing medium. Above the paper feed unit 18, a paper feed roller 19 is provided to feed the paper 17 to paper feed path 15. The paper feed path 15 is provided with a fixing device 20 at the terminating end. In the fixing device 20, the toner image transferred to paper 17 is fixed onto the paper 17.

Figure 2:
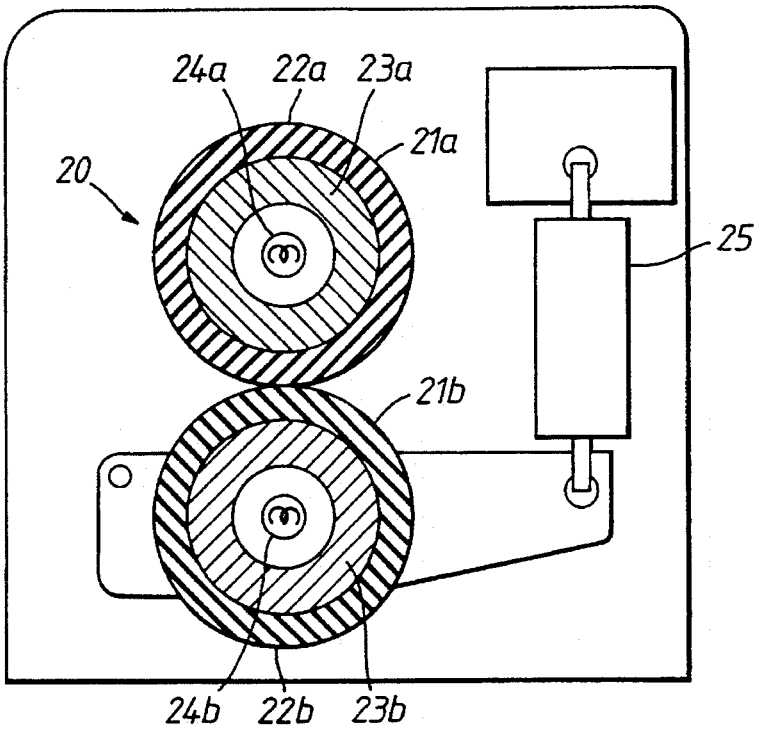
FIG. 2 is a diagram to schematically show a fixing unit according to an embodiment of the present invention.

FIG. 2 is a diagram to show details of the fixing device 20 for the image forming apparatus shown in FIG. 1. In FIG. 2, the fixing device 20 comprises a first roller 21*a* and a second roller 21*b*. The first roller 21*a* comprises a shaft 23*a* with a cavity at the center, a rubber layer 22*a* formed on the surface of the shaft 23*a* and a heater 24*a* disposed in the cavity of the shaft 23*a*. The second roller 21*b* comprises, similar to the first roller 21*a*, a shaft 23*b* with a cavity at the center, a rubber layer 22*b* formed on the surface of the shaft 23*b*, and a heater 24*b* disposed in the cavity of the shaft 23*b*. The first roller 21*a* and the second roller 21*b* are pressed against each other under pressure applied by a pressurizing spring 25 to the second roller 21*b*.

For improvement of the fixing characteristic of the fixing device 20, it is necessary to extend the fixing time. For this purpose, a larger nip width is required. When the outer diameters of the rollers is fixed, it is preferable to have a larger pressurizing force or a thicker rubber at the first roller 21*a* and the second roller 21*b* in order for a larger nip width. However, larger pressurizing force results in a larger amount of distortion at the roller shafts 23*a* and 23*b*.

On the other hand, when the rubber layers 22*a* and 22*b* on the first and second rollers 21*a* and 21*b* are made thicker, the outer diameters of the roller shafts 23*a* and 23*b* become smaller. This deteriorates the rigidity of the roller shafts 23*a* and 23*b*, which causes larger distortion at the roller shafts 23*a* and 23*b*. Larger distortion at the roller shafts 23*a* and 23*b* leads to paper wrinkle problem. Therefore, it is necessary to search for the optimum parameters including outer roller diameter, rubber thickness, rubber hardness and load for the widest possible nip width for a limited distortion amount for the roller shafts 23*a* and 23*b*. The inventors have studied these parameters and found the optimum combination of them as described below.

That is, the relation between the load and distortion amount can be expressed by the formula (1) below.

$$P=\frac{384\pi\delta}{320l^3}\times\frac{1}{\dfrac{1}{16E_1\{(R_1-h_1)^4-(R_1-h_1-t_1)^4\}}+\dfrac{1}{16E_2\{(R_2-h_2)^4-(R_2-h_2-t_2)^4\}}}$$
$$=\frac{96\pi\delta E_1E_2}{5l^3}\times\frac{\{(R_1-h_1)^4-(R_1-h_1-t_1)^4\}\{(R_2-h_2)^4-(R_2-h_2-t_2)^4\}}{E1\{(R_1-h_1)^4-(R_1-h_1-t_1)^4\}+E_2\{(R_2-h_2)^4-(R_2-h_2-t_2)^4\}} \quad (1)$$

Parameters in the formula (1) are as follows:

P: Load [Kgf]

$R_1$: First roller radius [mm]

$E_1$: Young's modulus of first roller shaft [Kg/mm$^2$]

$h_1$: Rubber layer thickness of first roller [mm]

$t_1$: Thickness of first roller shaft [mm]

$R_2$: Second roller radius [mm]

$E_2$: Young's modulus of second roller shaft [Kg/mm$^2$]

$h_2$: Rubber layer thickness of second roller [mm]

$t_2$: Thickness of second roller shaft [mm]

l: Distance between supporting points at the roller ends [mm]

δ: Distortion at shaft [mm]

On the other hand, when one of the rollers is a cylindrical rigid body and the other has rubber coating, the nip width N can be expressed by the formula (2) below.

$$N = 1.515\left(\frac{Ph}{lE_g} \times \frac{R_1R_2}{R_1+R_2}\right)^{1/3} \quad (2)$$

Parameters in the formula (3) are as follows:

h: Roller rubber thickness [mm]

$E_g$: Young's modulus of rubber [Kg/mm$^2$]

If both of the rollers are coated with rubber, the formula (3) is applied to the roller where the rubber makes a larger distortion. When N in the formula (3) is the maximum, the nip width takes the maximum value. When N takes the maximum value, h is equivalent to the value of h when $N^3$ in the formula (3) below is the maximum.

$$N^3 = 1.515^3\left(\frac{Ph}{lE_g} \times \frac{R_1R_2}{R_1+R_2}\right) \quad (3)$$

It is supposed here that the roller with a larger rubber distortion at the nip is the first roller and expressed with the subscript "1". When the formula (1) is applied to the formula (3), the following formula (4) is obtained.

$$N^3 = \frac{1.515^3}{lE_g} \times \frac{R_1R_2}{R_1+R_2} \times \frac{96\pi\delta E_1E_2}{5l^3} \times \frac{h_1\{A_1^4-(A_1-t_1)^4\}\{A_2^4-(A_2-t_2)^4\}}{E1\{A_1^4-(A_1-t_1)^4\}+E_2\{A_2^4-(A_2-t_2)^4\}} \quad (4)$$

$A_1=R_1-h_1$ $A_2=R_2-h_2$

Therefore, $N^3$ becomes maximum when $dN^3/dh_1=0$. That is, when $Y=A_2^4-(h_2-t_2)^4$ and $h_1$ satisfies the formula (5) below, the largest nip width is obtained.

$$[E_1\{A_1^4-(A_1-t_1)^4\}+E_2Y]\cdot[\{A_1^4-(A_1-t_1)^4\}+4h_1(-3t_1A_1^2+3t_1^2A_1-t_1^3)]+h_1\{A_1^4-(A_1-t_1)^4\}\cdot\{-4E_1(3t_1A_1^2-3t_1^2A_1+t_1^3)\}=0 \quad (5)$$

Figure 3:
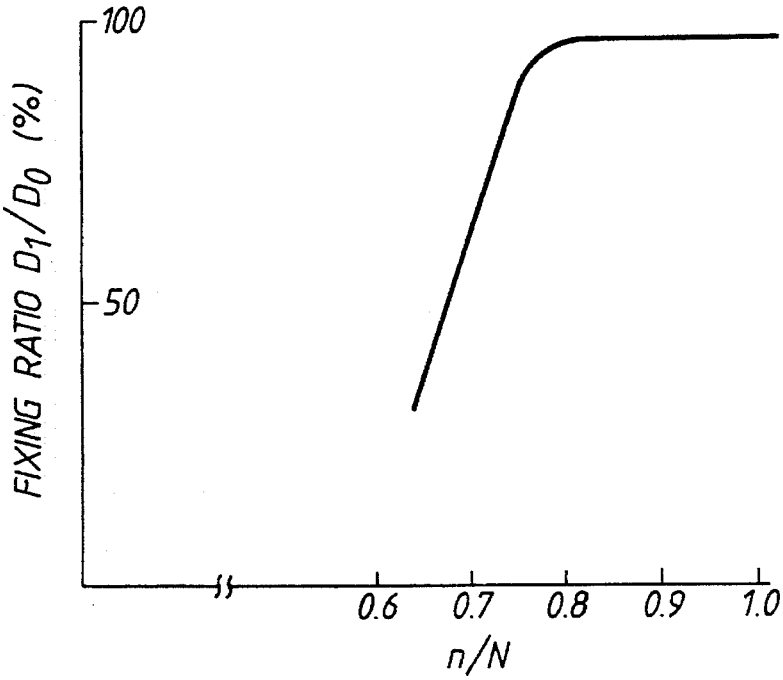
FIG. 3 is a graph showing the characteristic of the fixing ratio (%) versus the ratio between the nip width n and N (n/N) when the nip width is changed for the nip width N when the rubber layer thickness H takes the value for the maximum nip width.

FIG. 3 is a graph to show the characteristic of fixing ratio (%) against the ratio of the nip width n and N (n/N) for various values of the nip width N when the rubber layer thickness H causes the largest nip width. The fixing ratio can be expressed as the ratio between the reflection density $D_O$ before rubbing and the reflection density $D_1$ after rubbing ($D_1/D_0$) when the solid black part of the image is rubbed with nonwoven fabric for 100 times.

From FIG. 3, it is understood that the fixing ratio or the fixing characteristic becomes much worse when the nip width decreases by 20% or more from the maximum value N. When it is supposed that the rubber layer thickness $h_1$ satisfying the formula (5) is H, the range of the rubber layer $h_1$ for good fixing characteristic is as shown below, if the load is kept unchanged to prevent deterioration of image bearing medium feeding ability by 20% decrease of the nip width. According to the formula (6), $$0.8\times1.515\left(\frac{PH}{lE_g}\times\frac{R_1R_2}{R_1+R_2}\right)^{1/3} = 1.515\left(\frac{Ph_1}{lE_g}\times\frac{R_1R_2}{R_1+R_2}\right)^{1/3} \quad (6)$$

h=0.512H

Therefore, when $0.512H<h_1<H$, the nip width takes the maximum value with good fixing characteristic, Further, the inventors specifically measured the nip width when $0.512H<h_1<H$ is satisfied and when it is not satisfied. Table 1 below shows the results.

TABLE 1

| | Embodiment | Reference |
|---|---|---|
| $R_1$[mm] | 17.5 | 20 |
| $E_1$[Kgf/mm$^2$] | $0.73\times10^4$ | $0.73\times10^4$ |
| $t_1$[mm] | 4 | 15 |
| $h_1$[mm] | 2 | 5 |
| $E_g$[Kgf/mm$^2$] | 0.2 | 0.2 |
| $R_2$[mm] | 17.5 | 20 |
| $E_2$[Kgf/mm]$^2$ | $0.73\times10^4$ | $0.73\times10^4$ |
| $t_2$[mm] | 4 | 2 |
| $h_2$[mm] | 1 | 0.5 |
| δ[mm] | 0.82 | 0.82 |
| Ideal $h_1$[mm] | 1.55 to 3.04 | 1.35 to 2.64 |
| Nip width | 5.2 | 4.8 |

As clearly understood from Table 1 above, in spite of small outer diameter of the roller, the nip width in the embodiment of the present invention is larger than that in the reference.

Thus, according to the present invention, when the rubber layer thickness $h_1$ of the first roller satisfying the certain formulas concerned is H, $h_1$ satisfies the formula $0.512H<h<H$. This realizes the maximum nip width and, as a result, a fixing device and an image forming apparatus with a largely improved fixing characteristic can be provided.

In addition, a wider nip width enables temperature lowering at the heater on the roller, which leads to reduced power consumption.

Figure 4:
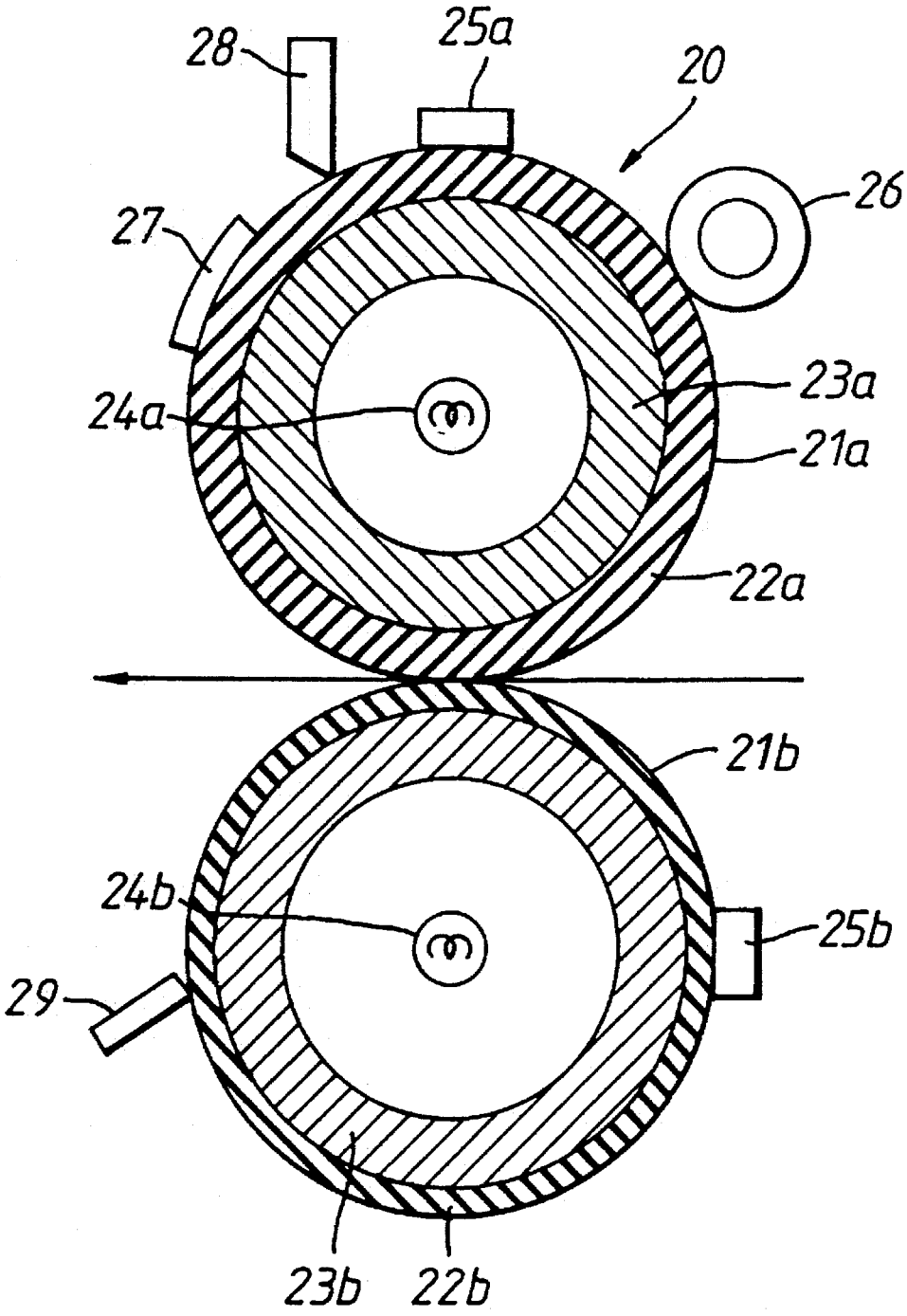
FIG. 4 is a diagram to show a fixing unit of image forming apparatus according to another embodiment of the present invention.

FIG. 4 shows another embodiment of the fixing device 20. The fixing device 20 comprises, in contact with the first roller 21*a* one the side contacting the developer image, a releaser application unit 26 consisting of a felt roller, a first cleaning member 27, a second cleaning member 28, and a thermistor 25*a*.

The thermistor 25*a* detects the outer surface temperature of the first roller 21*a* so that the electric current supplied to the heater 24*a* is controlled based on the detected temperature.

The releaser application unit 26 consisting of a felt roller applies releaser such as silicone oil to the first roller 21*a*. Such application of the releaser onto the surface of the first roller 21*a* prevents the toner from sticking to the first roller 21*a* and then sticking to the next image bearing medium (referred to as offset phenomenon). After fixing process, offset toner is sticking to the first roller 21*a* with silicone oil. Such offset toner and releaser on the first roller 21*a* are wiped off by the first cleaning member.

The first cleaning member 27 must be made of a material with cleaning capability for offset toner even after processing of several non fixed images. Specifically, preferable materials may be porous or foaming materials such as felt, considering the cost, maintenance, and size requirement (compactness).

Suppose several record materials are passed between the first and second rollers 21*a* and 21*b*. The first cleaning member 27 soaks up the silicone oil and when the soaked oil amount exceeds a certain level, the first cleaning member 27 acquires ability to supply the soaked silicone oil. As a result, an irregular oil layer is formed on the first roller 21*a*. Specifically, the oil coating layer has lines along the feed direction. Such oil layer is cleaned by the second cleaning member 28.

For the second cleaning member 28, it is preferable to use a blade of oil resistant materials such as a fluororubber blade. After passing of the second cleaning member 28, the first roller 21*a* becomes free from toner or oil.

The area where the releaser application unit 26 and the first roller 21*a* make contact must be designed to have the minimum speed difference from the peripheral speed of the first roller 21*a*. This is because, for a large speed ratio at the contact between the first roller 21*a* and the releaser application unit 26, many lines are generated on the releaser layer on the first roller 21*a* along the feed direction, which results in, upon fixing of solid image, a poor image quality with many vertical lines.

In order to reduce the speed difference between the releaser application unit 26 and the peripheral speed of the heat roller 21*a*, it is preferable to use a mechanism where the contact area with the first roller 21*a* can be moved to the peripheral movement direction of the first roller 21*a*. For example, a mechanism with a roller shaped rotary member is preferred. In this embodiment, a hollow shaft with many small bores with its ends tightly closed is filled with oil in it and wound with felt so that the oil soaked by the felt is applied. Here, for the peripheral speed of the first roller 21*a* and oil application, the relation between the speed ratio at the area where the releaser application unit 26 and the first roller 21*a* makes contact (first roller/releaser application unit) and generation of vertical lines on the fixed solid image is examined. The results are as follows.

1. Peripheral speed of first roller: 50 mm/s
Amount of oil application for gear ratio 1: 0.5 mg/A4

| Speed Ratio | Extent of Vertical Line Generation |
|---|---|
| 0 | Unacceptable vertical lines |
| 1/10 | Unacceptable vertical lines |
| 1/5 | Acceptable |
| 3/5 | Acceptable |
| 1 | Acceptable |
| 7/5 | Acceptable |
| 9/5 | Acceptable |
| 2 | Unacceptable vertical lines |

2. Peripheral speed of first roller: 80 mm/s
Amount of oil application for gear ratio 1: 0.5 mg/A4

| Speed Ratio | Extent of Vertical Line Generation |
|---|---|
| 0 | Unacceptable vertical lines |
| 1/10 | Unacceptable vertical lines |
| 1/5 | Acceptable |
| 3/5 | Acceptable |
| 1 | Acceptable |
| 7/5 | Acceptable |
| 9/5 | Acceptable |
| 2 | Unacceptable vertical lines |

-continued

3. Peripheral speed of first roller: 50 mm/s
Amount of oil application for gear ratio 1: 0.8 mg/A4

| Speed Ratio | Extent of Vertical Line Generation |
|---|---|
| 0 | Unacceptable vertical lines |
| 1/10 | Unacceptable vertical lines |
| 1/5 | Acceptable |
| 3/5 | Acceptable |
| 1 | Acceptable |
| 7/5 | Acceptable |
| 9/5 | Acceptable |
| 2 | Unacceptable vertical lines |

Thus, it is understood that a good fixed image can be obtained when the outer peripheral speed of the releaser application unit is 1/5 to 9/5 of the outer peripheral speed of the first roller 21*a* in the same direction as the first roller 21*a*. Even attar use for a long time, the surface of the releaser application unit 26 is free from contamination. The releaser application unit maintained a stable releaser application function for a long period.

Further, in this embodiment, the second roller 21*b* is also provided with a blade 29 to clean the oil coming from the first roller 21*a*. Without the blade 29, oil coming from the first roller 21*a* is accumulated and finally forms an oil layer on the back of (under) non fixed image. This may result in lower heat conductivity from the second roller 21*b* deteriorating the fixing characteristic and irregular oil layer generation causing uneven image. In this embodiment, the blade 29 is made of fluororubber.

The reference numeral 25*b* in the figure denotes a thermistor to detect the outer surface temperature of the second roller 21*b*. Based on thus detected temperature, the electric current supplied to the heater 24*b* is controlled.

What is claimed is:

1. An image forming apparatus including fixing means to fix a developer image on an image bearing medium, the fixing means comprising:

a first roller with a rubber layer coated on a first shaft, the first roller being in contact with the developer image on the image bearing medium; and a second roller with a rubber layer having a smaller deformation than the first roller rubber layer coated on a second shaft;

wherein the first and second rollers are rotatably pressed against each other to form a nip and $h_1$ satisfies $0.512H<h_1<H$, where H satisfies the following equation:

$$[E_1\{A_1^4-(A_1-t_1)^4\}+E_2Y]\cdot[\{A_1^4-(A_1-t_1)^4\}+4H(-3t_1A_1^2+3t_1^2A_1-t_1^3)]+H\{A_1^4-(A_1-t_1)^4\}\cdot\{-4E_1(3t_1A_1^2-3t_1^2A_1+t_1^3)\}=0$$

where $R_1$: first roller radius (mm)

$E_1$: Young's modulus of the first roller shaft (Kg/mm$^2$)

$t_1$: thickness of the first roller shaft (mm)

$h_1$: rubber layer thickness of the first roller (mm)

$R_2$: second roller radius (mm)

$E_2$: Young's modulus of the second roller shaft (Kg/mm$^2$)

$t_2$: thickness of the second roller shaft (mm)

$h_2$: rubber layer thickness of the second roller (mm)

$A_1=R_1-H$ $A_2=R_2-h_2$ $Y=A_2^4-(A_2-t_2)^4$.

2. An image forming apparatus according to claim 1, wherein the first roller includes a heater disposed in a cavity formed at the first shaft.

3. An image forming apparatus according to claim 1, wherein said second roller includes a heater disposed in a cavity formed at second shaft.

4. An image forming apparatus according to claim 1 further comprising:

application means for applying releaser to the first roller to prevent offset of the developer; and cleaning means for removing the developer and releaser sticking to the first roller.

5. An image forming apparatus according to claim 4, wherein the application means includes a roller member rotating in the direction with the first roller in contact with the developer image on the image bearing medium and its outer peripheral speed is 1/5 to 9/5 of the outer peripheral speed of the first roller.

6. A fixing device comprising:

a first roller with a rubber layer coated on a first shaft, the first roller being in contact with a developer image on an image bearing medium; and a second roller with a rubber layer having a smaller deformation than the first roller rubber layer coated on a second shaft;

wherein the first and second rollers are rotatably pressed against each other to form a nip and $h_1$ satisfies $0.512H<h_1<H$, where H satisfies the following equation:

$$[E_1\{A_1^4-(A_1-t_1)^4\}+E_2Y]\cdot[\{A_1^4-(A_1-t_1)^4\}+$$

-continued $$4H(-3t_1A_1^2+3t_1^2A_1-t_1^3)]+$$

$$H\{A_1^4-(A_1-t_1)^4\}\cdot\{-4E_1(3t_1A_1^2-3t_1^2A_1+t_1^3)\}=0$$

where $R_1$: first roller radius (mm)

$E_1$: Young's modulus of the first roller shaft ($Kg/mm^2$)

$t_1$: thickness of the first roller shaft (mm)

$h_1$: rubber layer thickness of the first roller (mm)

$R_2$: second roller radius (mm)

$E_2$: Young's modulus of the second roller shaft ($Kg/mm^2$)

$t_2$: thickness of the second roller shaft (mm)

$h_2$: rubber layer thickness of the second roller (mm)

$A_1=R_1-H$ $A_2=R_2-h_2$ $Y=A_2^4-(A_2-t_2)^4$.

7. A fixing device according to claim 6, wherein the first roller includes a heater disposed in a cavity formed at the first shaft.

8. A fixing device according to claim 6, wherein said second roller includes a heater disposed in a cavity formed at the second shaft.

9. A fixing device according to claim 6 further comprising:

application means for applying releaser to the first roller to prevent offset of the developer; and cleaning means for removing the developer and releaser sticking to the first roller.

10. A fixing device according to claim 9, wherein the application means includes a roller member rotating in the direction with the first roller in contact with the developer image on the image bearing medium and its outer peripheral speed is 1/5 to 9/5 of the outer peripheral speed of the first roller.

* * * * *